US005218269A

United States Patent [19]

Bouchard

[11] Patent Number: 5,218,269

[45] Date of Patent: Jun. 8, 1993

[54] NEGATIVE GLOW DISCHARGE LAMP HAVING WIRE ANODE

[75] Inventor: Andre C. Bouchard, Peabody, Mass.

[73] Assignee: GTE Products Corporation, Danvers, Mass.

[21] Appl. No.: 800,828

[22] Filed: Nov. 29, 1991

[51] Int. Cl.[5] ..... H01J 61/067

[52] U.S. Cl. ..... 313/619; 313/620; 313/622; 313/632; 313/491

[58] Field of Search ..... 313/619, 632, 622, 520, 313/620, 574, 491

[56] References Cited

U.S. PATENT DOCUMENTS

| | | | |
|---|---|---|---|
| 1,933,832 | 11/1933 | von Mihaly | 313/622 |
| 2,063,580 | 12/1936 | Braselton | 313/622 X |
| 2,067,129 | 1/1937 | Marden | 250/27.5 |
| 2,403,184 | 7/1945 | Lemmers | 176/122 |
| 2,507,696 | 5/1950 | Depp | 313/620 X |
| 3,814,971 | 6/1974 | Bhattacharya | 313/226 |
| 4,408,141 | 10/1983 | Byszewski et al. | 315/56 |
| 4,904,900 | 2/1990 | Bouchard et al. | 313/491 |
| 4,962,334 | 10/1990 | Godyak | 313/619 |

*Primary Examiner*—Palmer C. DeMeo
*Attorney, Agent, or Firm*—Carlo S. Bessone

[57] ABSTRACT

A glow discharge lamp includes a light-transmitting envelope containing a noble gas fill material. An anode electrode and a cathode electrode are spacedly located within the envelope. The anode electrode includes a single wire having a convoluted portion adjacent the cathode electrode and lying in a plane parallel to a plane intersecting the cathode electrode and a pair of lead-in wires supporting the cathode electrode. The improved anode construction results in an increase in both light output and lamp efficacy.

17 Claims, 1 Drawing Sheet

NEGATIVE GLOW DISCHARGE LAMP HAVING WIRE ANODE

FIELD OF THE INVENTION

This invention relates in general to a compact fluorescent lamp and pertains, more particularly, to a negative glow discharge lamp.

BACKGROUND OF THE INVENTION

A negative glow discharge lamp is comprised of a light-transmitting envelope containing a noble gas and mercury with a phosphor coating on an inner surface of the envelope which is adapted to emit visible light upon absorption of ultraviolet radiation that occurs when the lamp is excited. The lamp is excited by means of the application of a voltage between the lamp electrodes. Current flows between the electrodes after a certain potential is applied to the electrodes, commonly referred to as the breakdown voltage. An elementary explanation of the phenomenon is that the gas between the electrodes becomes ionized at a certain voltage, conducts current, and emits ultraviolet radiation. Examples of typical glow discharge lamps are found in U.S. Pat. No. 2,067,129 to Marden; U.S. Pat. No. 2,403,184 to Lemmers; U.S. Pat. No. 3,814,971 to Bhattacharya; and U.S. Pat. No. 4,408,141 to Byszewski et al.

Reference is also made herein to U.S. Pat. No. 4,904,900 which issued to Bouchard et al on Feb. 27, 1990 and is assigned to the same Assignee as the present application. The Bouchard et al patent teaches a negative glow discharge lamp that includes a light-transmitting envelope containing a noble gas fill material and a pair of electrodes disposed in the envelope. The anode electrode is comprised of a refractory metal piece, such as a molybdenum foil strip, supported from one end of a single lead-in wire that is preferably swagged to the metal strip.

Although the above-described negative glow discharge lamp of Bouchard et al has been employed with a high degree of success, it has been found that certain disadvantages do exist. More specifically, it has been found that if an insufficient pressure is applied to the end of the lead-in wire, the molybdenum foil may separate from the swagged lead-in wire during lamp operation leaving the remaining lead-in wire to function as the anode electrode. We have discovered that the reduced surface area of the remaining anode wire may run excessively hot during operation and greatly diminish the light output due to evaporation of the anode wire end. Additionally, the swagging operation adds cost and complexity to the lamp.

SUMMARY OF THE INVENTION

It is, therefore, an object of the present invention to obviate the disadvantages of the prior art.

It is still another object of the invention to provide an improved negative glow discharge lamp having an improved anode construction.

It is another object of the invention to provide an improved negative glow discharge lamp having an anode construction that does not require a swagging operation.

It is still another object of the invention to provide an improved negative glow discharge lamp having an anode that is a relatively inexpensive and more simplified construction, and that is characterized by improved overall luminance output and lamp efficacy.

These objects are accomplished in one aspect of the invention by the provision of a negative glow discharge lamp that is comprised of a light-transmitting envelope containing a noble gas fill material. Anode and cathode electrodes are disposed in the envelope and are separated a predetermined distance thereapart. Lead-in wires couple to the cathode electrode and extend through and are hermetically sealed in the envelope. The anode electrode comprises a single wire hermetically sealed in the envelope and having a convoluted portion adjacent the cathode electrode. The convoluted anode portion lies in a plane parallel to a plane intersecting the cathode electrode and the cathode lead-in wires. Preferably, the convoluted anode portion has a triple-bend construction.

In accordance with a preferred embodiment of the present invention, the convoluted anode portion includes three U-shaped portions joining four parallelly-spaced leg portions.

In accordance with another preferred embodiment of the present invention, the convoluted anode portion includes three V-shaped portions joining four leg portions. Preferably, the convoluted anode portion in this embodiment includes two leg portions parallel to the longitudinal axis of the lamp and two leg portions in parallel with each other but offset from the longitudinal axis. The three V-shaped portions form angles having a range of from about 20 to 50 degrees.

In accordance with still further teachings of the present invention, the convoluted anode portion has a surface area of about 1.5 $cm^2$. Preferably, the electrodes are spaced about 1.2 centimeters apart.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BRIEF DESCRIPTION OF THE DRAWINGS

The invention will become more readily apparent from the following exemplary description in connection with the accompanying drawings, wherein.

FIG. represents a front elevation cross-sectional view of a preferred embodiment of a glow discharge lamp constructed in accordance with the principles of the present invention and employing a wire anode electrode having a convoluted shape.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
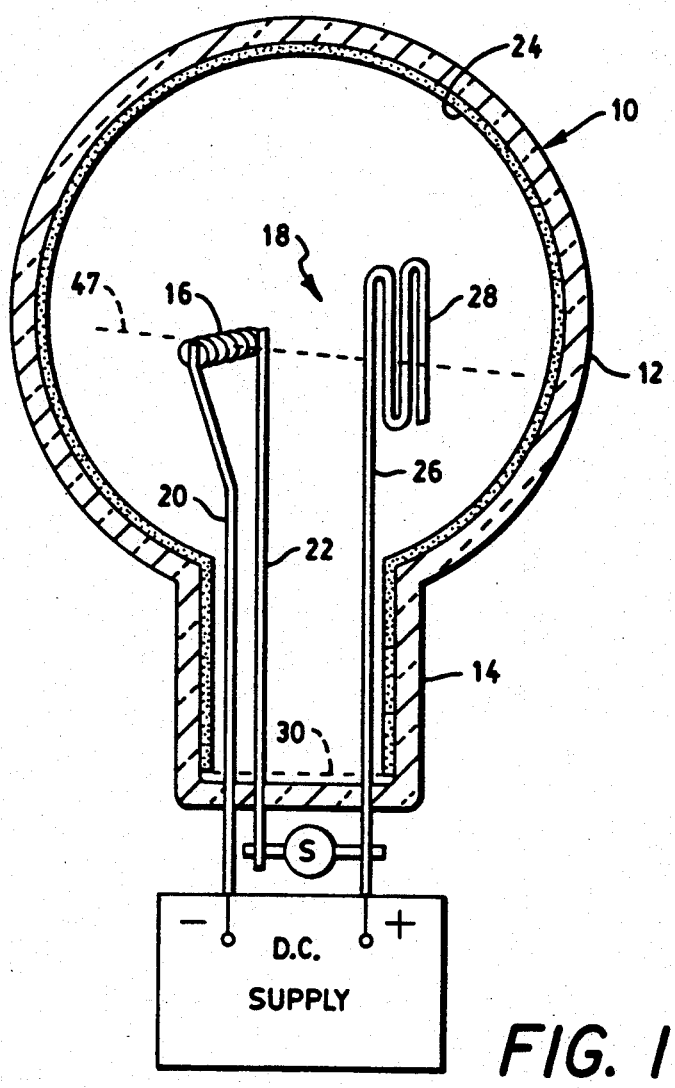

Referring to the drawings, FIG. 1 illustrates a negative glow discharge lamp including a light-transmitting envelope 10 having a bulbous or spherical-shaped region 12 and a neck region 14. Region 12 of envelope 10 has an internal radius of, for example, 3.5 centimeters. Within spherical-shaped region 12 of envelope 10 there is disposed a pair of electrodes such as a cathode electrode 16 and an anode electrode 18 constructed from a single wire 26. The electrodes are typically spaced approximately 1 to 3 centimeters apart.

Cathode electrode 16 may be a tungsten exciter coil having a co-precipitated triple carbonate suspension, usually comprising strontium carbonate, calcium carbonate, and barium carbonate deposited thereon. The cathode electrode can vary in size, mass and geometry depending on starting features required, expected life and current carrying capabilities. During lamp manufacturing, the carbonates are converted to oxides during the well known breakdown or activation process in which current is passed through the cathode for a predetermined amount of time. A pair of lead-in wires 20 and 22 support cathode electrode 16 and provide electrical power thereto. Lead-in wires 20 and 22 may be rod-like of say 20–30 mil diameter. Both the lead-in wires 20 and 22 are hermetically sealed, such as, by means of a wafer stem assembly 30 that closes the bottom neck region 14 of lamp envelope 10 as illustrated in FIG. 1. Lead-in wires 20 and 22 are preferably constructed of molybdenum to provide proper lamp construction and operation.

As further shown in FIG. lead-in wire 20 and anode wire 26 are respectively connected to the negative and positive terminals of a DC power supply. To start the lamp, preheat current is supplied to cathode electrode 16 by momentarily connecting together lead-in wire 22 and anode wire 26. As illustrated in FIG. 1, a conventional glow discharge starter S may be secured to lead-in wire 22 and anode wire 26 to facilitate the preheating and starting. Upon ignition, a glow discharge is produced between cathode electrode 16 and anode electrode 18.

Envelope 10 contains a fill material that emits ultraviolet radiation upon excitation. This fill material may contain mercury and a noble gas, such as helium, neon, argon, krypton and xenon or a mixture of noble gases. In one embodiment, the lamp may be filled with a noble gas mixture at 3 torr. This mixture may be 99.5% neon and 0.5% argon with approximately 30 milligrams in weight of mercury. The internal surface of lamp envelope 10 has a phosphor coating 24 which emits visible light upon absorption of ultraviolet radiation.

In accordance with the teachings of the present invention, anode electrode 18 is constructed from a single wire 26 having a portion thereof hermetically sealed in wafer stem 30 of envelope 10. Anode electrode 18 may be constructed of vacuum fired molybdenum wire having a diameter of 0.07 centimeter.

As illustrated in the embodiment of FIG. 1, anode electrode 18 has a convoluted portion 28 adjacent cathode electrode 16. Convoluted anode portion 28 of electrode 18 lies in a plane parallel to a plane intersecting cathode electrode 16 and lead-in wires 20 and 22. The surface area of the convoluted anode portion 28 must be sufficient to prevent the wire anode from running excessively hot and to prevent evaporation of the wire. It has been found that a convoluted anode portion having a surface area of approximately 1.5 centimeters$^2$ is effective.

Figure 2:
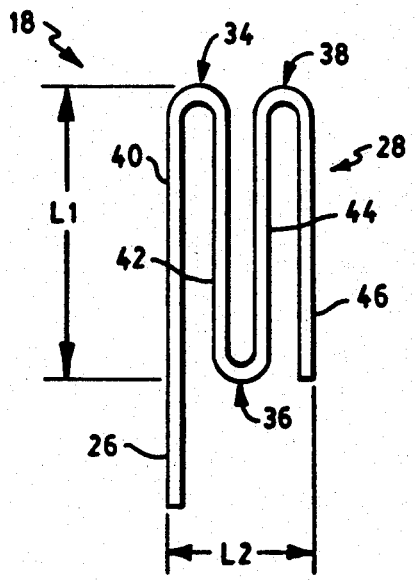
FIG. 2 is an enlarged view of the wire anode electrode of FIG. 1.
Figure 3:
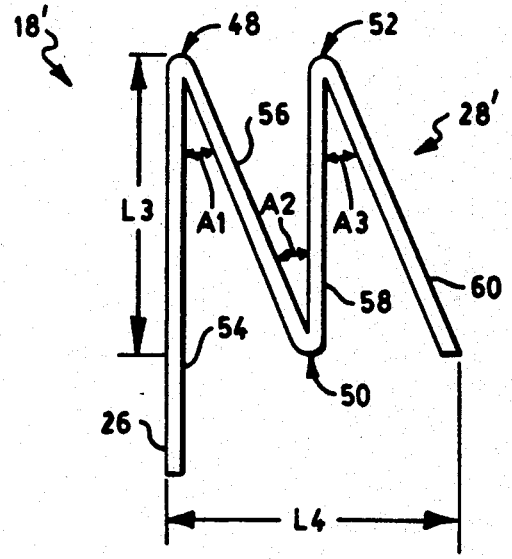
FIG. 3 is an enlarged view of another embodiment of a wire anode electrode.

With particular attention to FIGS. 2 and 3, convoluted portion 28 of anode electrode 18 may have a triple-bend construction. As shown in the embodiment of FIG. 2, anode portion 28 may include three U-shaped portions 34, 36, and 38 joining four parallelly-spaced leg portions 40, 42, 44 and 46. As illustrated in FIG. 1, cathode electrode 16 and convoluted anode portion 28 are approximately centered relative to each other as noted by a center line 47 which perpendicularly intersects both cathode electrode 16 and the center of anode portion 28.

In another embodiment as depicted in FIG. 3, convoluted anode portion 18′ includes three V-shaped portions 48, 50, and 52 joining four leg portions 54, 56, 58 and 60. Leg portions 54 and 58 are parallel to the longitudinal axis of the lamp. Leg portions 56 and 60 of anode portion 18′ are approximately in parallel with each other but offset from the longitudinal axis of the lamp. As illustrated in FIG. 3, an angle A1 is formed between leg portions 54 and 56, and angle A2 is formed between leg portions 56 and 58 and an angle A3 is formed between leg portions 58 and 60. Angles A1, A2 and A3 may be equal to each other. Typically, angles A1, A2 and A3 range from about 20 to 50 degrees.

In a typical but non-limitative example of the present invention, two test groups of lamps negative glow discharge lamps were constructed having anode electrode constructions as depicted in FIGS. 2 and 3. The first group of lamps contained anode electrodes as shown in FIG. 2 wherein length L1 of anode portion 28 was equal to 2.0 centimeters and width L2 was equal to 0.5 centimeter. The second group of lamps contained anode electrodes as shown in FIG. 3 wherein length L3 of anode portion 28′ was equal to 2.0 centimeters and width L4 was equal to 1.5 centimeters. A group of control lamps contained an anode electrode constructed from a strip of molybdenum foil 4.5 mm wide, 16.5 mm long and 0.01 mm thick. The moly strip was swagged to a molybdenum support wire. Each lamp contained a mixture of 99.5% neon and 0.5% argon at 3.0 torr with approximately 30 milligrams in weight of mercury. The internal surface of each lamp envelope was coated with a blend of red emitting yttrium oxide and green emitting lanthanum phosphate phosphor. The cathode and anode electrodes in each lamp were spaced about 1.2 centimeters apart. TABLE I below illustrates the electrical parameters of the above-described lamps.

TABLE I

| ANODE CONSTRUCTION | I (AMPS) | V (VOLTS) | W (WATTS) | L (LUMENS) | LUMENS PER WATT |
|---|---|---|---|---|---|
| MOLY FOIL | 2.0 | 14.2 | 27.0 | 776 | 26.0 |
| FIG. 2 | 2.0 | 14.2 | 27.0 | 804 | 27.0 |
| FIG. 3 | 2.0 | 14.4 | 27.4 | 818 | 27.1 |

It was discovered unexpectedly that the light output and efficacy (i.e., lumens per watt) of lamps having the simplified anode construction of the present invention were higher than those of lamps made with a molybdenum foil swagged to a support wire. More specifically, lamps having an anode construction similar to that depicted in FIG. 2 show a 3.6% increase in light output and a 3.8% increase in lamp efficacy over that of lamps having the swagged molybdenum foil anode. Similarly, lamps having an anode construction similar to that depicted in FIG. 3 show a 5.4% increase in light output and a 4.2% increase in lamp efficacy over that of lamps having the swagged molybdenum foil anode.

There has thus been shown and described an improved negative glow discharge lamp. The invention provides a negative glow discharge lamp having an anode that is of a relatively inexpensive and more simplified construction, and that is characterized by improved overall luminance output and lamp efficacy. The improved anode construction does not require an additional swagging operation.

While there have been shown and described what are at present considered to be the preferred embodiments of the invention, it will be apparent to those skilled in the art that various changes and modifications can be made herein without departing from the scope of the invention as defined by the appended claims. For example, the convoluted anode portion may be coiled, circular or rectangular in shape.

What is claimed is:

1. A negative glow discharge lamp comprising:
a light-transmitting envelope containing a noble gas fill material;
anode and cathode electrodes disposed in said envelope and separated a predetermined distance thereapart; and
lead-in wires coupled to said cathode electrode and extending through and hermetically sealed in said envelope;
said anode electrode comprising a single wire hermetically sealed in said envelope and having a convoluted anode portion adjacent said cathode electrode and lying in a plane parallel to a plane intersecting said cathode electrode and said lead-in wires, said convoluted anode portion having a triple-bend construction including three U-shaped portions joining four parallelly-spaced leg portions.

2. The negative glow discharge lamp of claim 1 wherein said convoluted anode portion has a longitudinal length equal to 2.0 centimeters and a width equal to 0.5 centimeter.

3. The negative glow discharge lamp of claim 1 wherein said convoluted anode portion has a surface area of about 1.5 $cm^2$.

4. The negative glow discharge lamp of claim 1 wherein said distance between said anode and cathode electrodes is equal to 1.2 centimeters.

5. A negative glow discharge lamp comprising:
a light-transmitting envelope containing a noble gas fill material;
anode and cathode electrodes disposed in said envelope and separated a predetermined distance thereapart; and
lead-in wires coupled to said cathode electrode and extending through and hermetically sealed in said envelope;
said anode electrode comprising a single wire hermetically sealed in said envelope and having a convoluted anode portion adjacent said cathode electrode and lying in a plane parallel to a plane intersecting said cathode electrode and said lead-in wires, said convoluted anode portion having a triple-bend construction including three V-shaped portions joining four leg portions, two of said leg portions being parallel to the longitudinal axis of said lamp, the other two of said leg portions being parallel with each other but offset from said longitudinal axis.

6. The negative glow discharge lamp of claim 5 wherein said convoluted anode portion has a longitudinal length equal to 2.0 centimeters and a width equal to 1.5 centimeters.

7. The negative glow discharge lamp of claim 5 wherein said convoluted anode portion has a surface area of about 1.5 $cm^2$.

8. The negative glow discharge lamp of claim 5 wherein said distance between said anode and cathode electrodes is equal to 1.2 centimeters.

9. A negative glow discharge lamp comprising:
a light-transmitting envelope containing a noble gas fill material;
anode and cathode electrodes disposed in said envelope and separated a predetermined distance thereapart; and
lead-in wires coupled to said cathode electrode and extending through and hermetically sealed in said envelope;
said anode electrode comprising a single wire hermetically sealed in said envelope and having a convoluted anode portion of a triple-bend construction adjacent said cathode electrode and lying in a plane parallel to a plane intersecting said cathode electrode and said lead-in wires.

10. The negative glow discharge lamp of claim 9 wherein said convoluted anode portion includes three V-shaped portions joining four parallelly-spaced leg portions.

11. The negative glow discharge lamp of claim 10 wherein said convoluted anode portion has a longitudinal length equal to 2.0 centimeters and a width equal to 0.5 centimeter.

12. The negative glow discharge lamp of claim 9 wherein said convoluted anode portion includes three V-shaped portions joining four leg portions.

13. The negative glow discharge lamp of claim 12 wherein said convoluted anode portion includes two leg portions parallel to the longitudinal axis of said lamp and two leg portions in parallel with each other but offset from said longitudinal axis.

14. The negative glow discharge lamp of claim 13 wherein said convoluted anode portion has a longitudinal length equal to 2.0 centimeters and a width equal to 1.5 centimeters.

15. The negative glow discharge lamp of claim 12 wherein said three V-shaped portions form angles having a range of from about 20 to 50 degrees.

16. The negative glow discharge lamp of claim 9 wherein said convoluted anode portion has a surface area of about 1.5 $cm^2$.

17. The negative glow discharge lamp of claim 9 wherein said distance between said anode and cathode electrodes is equal to 1.2 centimeters.

* * * * *